United States Patent [19]

Lerouge et al.

[11] 4,449,920

[45] May 22, 1984

[54] DEVICE FOR IGNITING A TORCH

[75] Inventors: André Lerouge, Argent sur Sauldre; Jean-Louis Andre, Vitry; Pierre Coutin, Paris, all of France

[73] Assignees: R. Alkan & Cie, Valenton; Elf France, Paris, both of France

[21] Appl. No.: 393,797

[22] Filed: Jun. 30, 1982

[30] Foreign Application Priority Data

Jul. 3, 1981 [FR] France ..... 81 13170

[51] Int. Cl.[3] ..... F41H 9/02

[52] U.S. Cl. ..... 431/91; 431/202; 431/267; 431/269; 431/283

[58] Field of Search ..... 431/91, 202, 286, 267, 431/278, 270, 283, 271, 284; 4/2, 6, 7; 102/363

[56] References Cited

U.S. PATENT DOCUMENTS 2,952,309 9/1960 Fay ..... 431/91

3,635,649 1/1972 Kafka ..... 431/269

*Primary Examiner*—Samuel Scott

*Assistant Examiner*—Randall L. Green

*Attorney, Agent, or Firm*—Brisebois & Kruger

[57] ABSTRACT

A device for igniting a torch by means of pyrotechnical cartridges, wherein each cartridge is placed in a casing located at a first distance of one to ten meters from the geometrical axis of the torch and at a second distance of two to twenty meters below the orifice of said torch, said casing being provided with a cover adapted to be moved from a closed position wherein the cartridges within the casing are contained in a thermally isolated tight compartment to an open position wherein each cartridge is aimed at a selected point located on the torch axis at a third distance of one to ten meters above the torch orifice, said second distance being greater than said third distance, and said first, second and third distances being selected in such a manner that a/(b+c) has a value comprised between tangent 45° and tangent 20°, wherein a represents said first distance, b represents said second distance, and c represents said third distance.

7 Claims, 6 Drawing Figures

DEVICE FOR IGNITING A TORCH

FIELD OF THE INVENTION

The present invention is related to a device for igniting torches by means of pyrotechnical cartridges.

BACKGROUND OF THE INVENTION

Such devices are used for igniting torches which are fed in a substantially discontinuous manner, or for igniting torches under exceptional conditions, e.g., during well testing, or for igniting a torch as an ultimate security measure when the conventional security means continuously maintained become inoperative due to failure of the gas feeding system pilot burners, or due to disturbance of an electric system, or similar occurrences.

The known torch igniting devices using pyrotechnical cartridges are actuated manually from the ground, and consequently propulsing means are required for propulsing the combustible elements in such a manner that they cross the cone formed by the gases issuing from the torch orifice at an altitude above the ground which in many cases exceeds fifty meters.

The known device have two major drawbacks, to wit:

(a) the lack of precision of the ballistic propulsion according to a path having a pronounced curvature, especially in its effective portion passing through the gas cone, said path being very sensitive to the atmospheric conditions, and more particularly to the variations of the direction of the wind;

(b) the necessity of maintaining the propulsed elements in a state of combustion over a large portion of their path, whereby it becomes inevitable that fragments thereof will fall backward toward the ground while still in a state of ignition.

It is an object of the instant invention to overcome these drawbacks by placing the igniting device at the smallest distance possible from the torch outlet orifice, whereby it is possible to shoot (or fire) straight in a substantially more accurate manner than in the case of the curved shooting path obtained with the known devices; furthermore, the arrangement according to the invention enables to confer on the propulsed elements of the cartridge characteristics which result in a reduced combustion time, and consequently cartridge fragments reaching the immediate vicinity of the torch will have a temperature close to the ambient temperature, whereby any fire hazard is excluded.

SUMMARY DEFINITION OF THE INVENTION

With these and other objects in view the present invention provides a device for igniting a torch by means of pyrotechnical cartridges, wherein each cartridge is placed in a casing located at a first distance of one to ten meters from the geometrical axis of the torch and at a second distance of one to twenty meters below the orifice of said torch, said casing being provided with a cover adapted to be moved from a closed position wherein the cartridges within the casing are contained in a thermally isolated tight compartment to an open position wherein each cartridge is aimed at a selected point located on the torch axis at a third distance of one to ten meters above the torch orifice, said second distance being greater than said third distance, and said first, second and third distances being selected in such a manner that $a/(b+c)$ has a value comprised between tangent 45° and tangent 20°, wherein a represents said first distance, b represents said second distance, and c represents said third distance.

In a preferred embodiment of the invention each cartridge comprises a propulsion element and at least one propulsed combustive element, or "star", the combustion duration of which is so selected that the combustion of said element is completed during a trajectory the length of which is comprised between 1.2 and 3 times the distance between said casing and said selected point of the torch axis.

In various embodiments of the invention, which are designed with a view to ensuring the tightness and thermal isolation of the compartment containing said cartridges, when said casing is in its closed position, said compartment is surrounded by a space in which cooling air is circulated, and is further surrounded by a continuous sheath of heat-insulating material.

In these above-mentioned embodiments, each cartridge placed in a thermally isolated tight compartment within the casing is disposed within a cylindrical box the lower orifice of which is sealed by a plug provided with a passage for igniting means, while the upper orifice of said box is sealed by a lid adapted to be fractured under the effect of the igniting (firing) of the cartridge.

Although the compartment containing the cartridges is tight, the tightness or sealing characteristics of the boxes containing each a cartridge confer a supplementary garanty of long life time on the elements of the pyrotechnical products contained in the cartridge.

In a preferred embodiment, the cover of each casing is adapted to be displaced from its closed position to its open position by means of a hinged jack provided within the tight, thermally isolated compartment.

When torches are provided for evacuating residual gases at reduced flow-rates, the casings are located on a bridge easily accessible from the ground.

In the case of high flow-rate torches, i.e. torches adapted to evacuate residual gases at high flow rates, the casings are movable from their working position to a maintenance position and, possibly, to an intermediary waiting position, by convenient handling means.

The invention will be described herein-below in a more detailed manner, especially with reference to the appended Figures which are given by way of illustration, but not of limitation.

DETAILED DESCRIPTION OR PREFERRED EMBODIMENT OF THE INVENTION

Figures 1, 2:
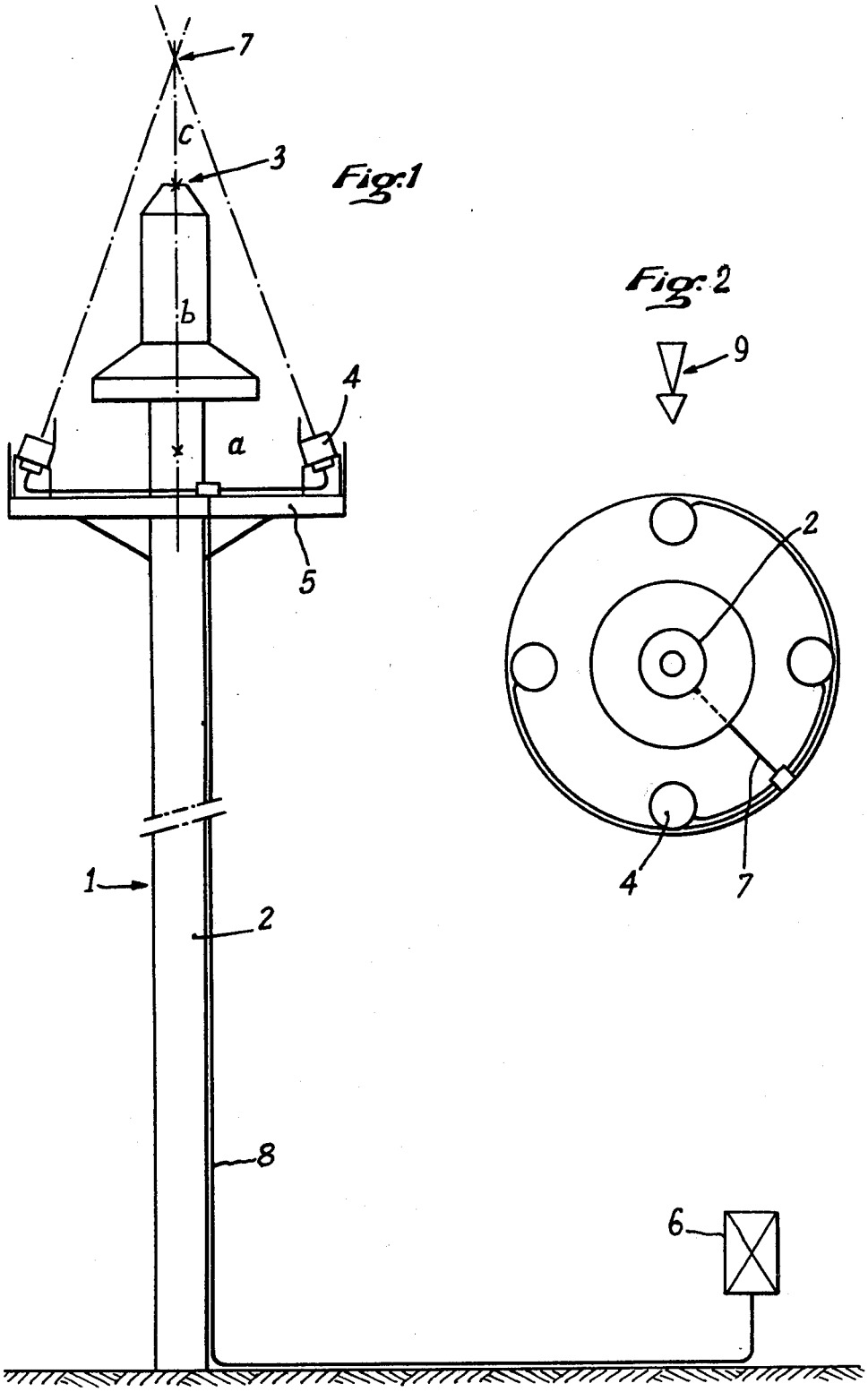
FIG. 1 shows schematically an installation for igniting a torch.
FIG. 2 illustrates the orientation of a casing with respect to the direction of the dominating wind.

FIG. 1 shows a torch 1 comprising a vertical conduit 2 having a geometrical axis ZZ' and opening into an end orifice 3. Vertical conduit 2 may be self-sustaining as shown in FIG. 1, or may be supported by a metallic structure (not shown) or maintained by bracing wire or the like.

Torch 1 is provided with an igniting device comprising casings 4 adapted to launch pyrotechnical cartridges, which casings are located at a first distance a of one to ten meters from the axis ZZ' of conduit 2 and at a second distance b of two to twenty meters above the orifice 3 of the torch. Generally distance a will be in the order of several meters, and distance b will be in the order of about ten meters.

Said casings are inclined in such a manner that the axis of the casing, or launching axis, intersects axis ZZ' at a point 7 located at a third distance c of one to ten meters above orifice 3, and preferably at a distance of several meters therefrom.

With a view to obtaining optimum operating conditions distances a, b and c are so selected that distance b is smaller than distance a, and that $a/(b+c)$ is comprised between tangent 45° and tangent 20°.

Casings 4 are connected to an electric control station 6 by an electric connection 8.

FIG. 2 shows four casings 4 mounted on a platform 5; two casings are aligned in the direction 9 of the predominant wind, while the remaining two casings ae aligned in a direction perpendicular thereto.

Figure 3:
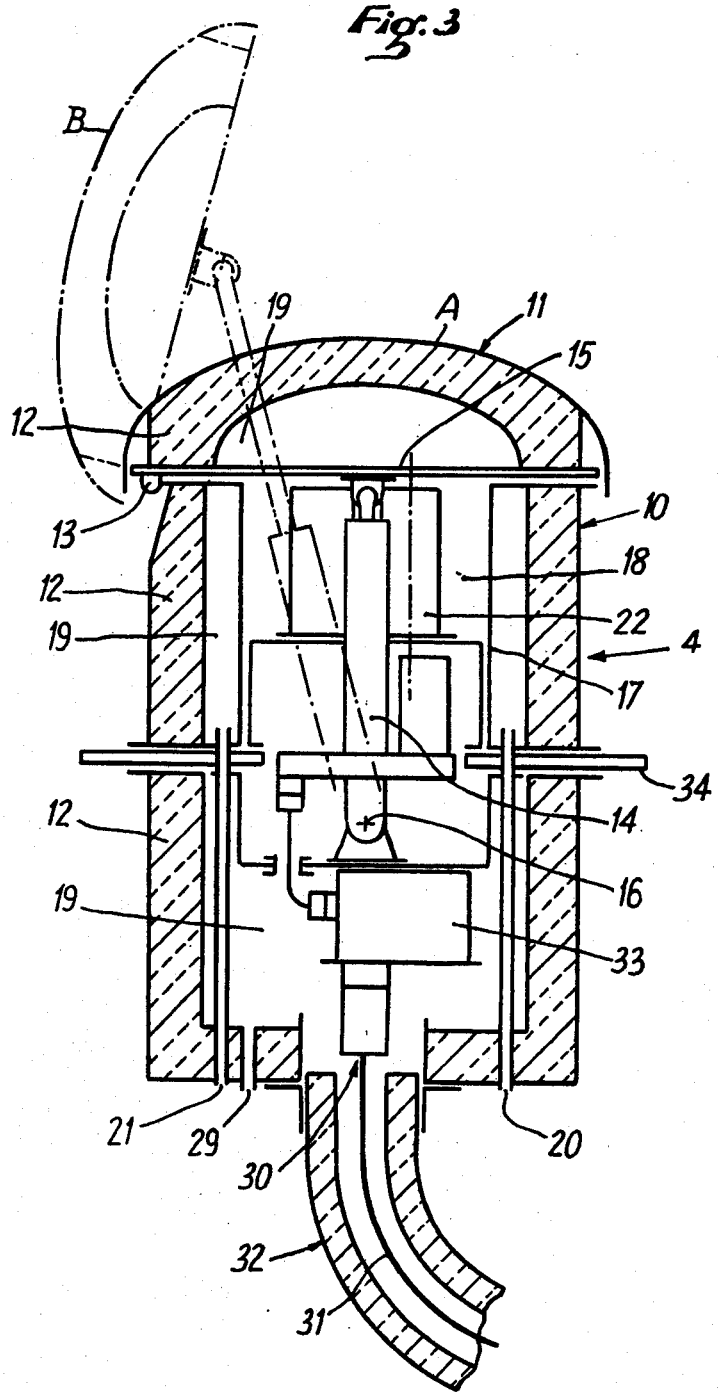
FIG. 3 is a view in longitudinal section of a launching casing.

FIG. 3 shows, in longitudinal section, a launching casing 4 comprising a casing body 10 having a double wall, and a cover 11 having also a double wall; a space 12 defined between said double walls is filled with a thermally isolating matter constituting a continuous protecting sheath.

Cover 11 is adapted to be moved from a closed position A shown in FIG. 3 in full lines to an open position B shown in FIG. 3 in dash-point lines, said cover being movable about an axis 13 under the action of an electric jack 14. Said jack 14 is hinged at one of its ends, at 15, to cover 11, while the other end of said jack is hinged, at 16, to an element integral with the body 10 of casing 4.

A lining 17 provided within body 10 of the casing constitutes the envelope of a tight, thermally isolated compartment 18; said lining delimits, in combination with the inner wall of body 10, a space 19 wherein a forced circulation of fresh air is generated, said air entering through a nozzle such as 20 and issuing through a nozzle such as 21.

Figure 4:
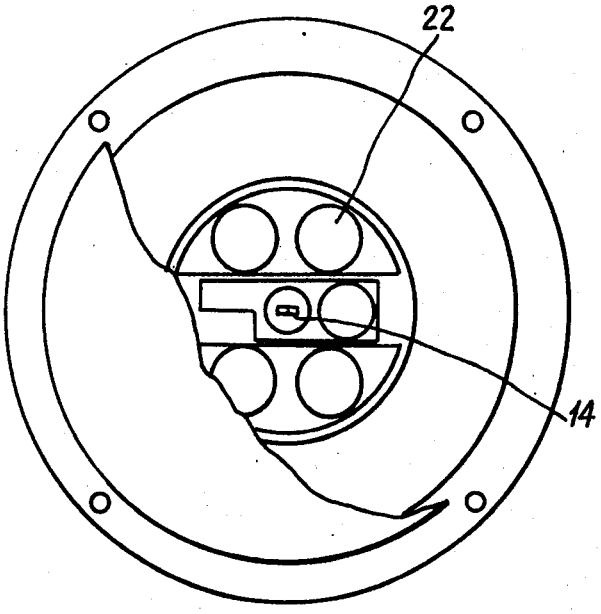
FIG. 4 shows the arrangement of the cartridges within a casing.
Figure 5:
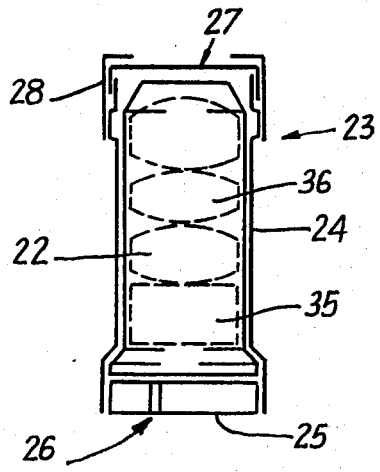
FIG. 5 shows a cartridge box in longitudinal section.

Reference numeral 22 designates one of the four pyrotechnical cartridges associated to the launching casing 4; said cartridges are distributed on either side of launching jack 14, as shown in FIG. 4, and are placed within a tight box, as shown in FIG. 5.

Such box 23 is constituted by a tubular envelope 24 comprising a lower bottom formed by a removable plug 25 which allows the cartridge to be introduced into the box, said bottom being provided with a through-hole 26 constituting a passage for an electric conductor connecting the cartridge to the firing means, and an upper bottom constituted by a lid 27 of the frangible (or fracturable) type which is designed to be destroyed by the firing of the cartridge. Said lid is blocked on the upper contour of the cylindrical envelope 24 by a collar 28 ensuring a tightly sealed assembly.

Further to apertures 20 and 21 for the cooling air inlet and outlet conduits, body 10 of casing 4 comprises an aperture 29 for evacuating possibly formed condensation water, and an aperture 30 defining the inlet of a general electric feed cable 31 surrounded by a fireproof sheath 32, said cable being connected to a casing 33 ensuring the distribution of the circuits related to the jack 14 and to the cartridges such as 22.

In its median portion, body 10 of casing 4 comprises an inserted plate 34 which defines the mounting plane of the device, said plate being fixed onto a support adjustable in situ (not shown).

The four cartridges 22 are supported on said plate 24 through plugs 25 which constitute the respective bottoms of boxes 23.

The drawing does not show the sealing elements conventionally used in this type of assemblies.

FIG. 5 schematically illustrates, in dash lines, the filling of cartridge 22; this Figure shows one propulsion element 35 and three propulsed elements 36 or so-called "stars". The combustion time of said propulsed elements 36 is so selected that this combusion is achieved entirely on a trajectory the length of which represents 1.2 to 3 times the distance between the casing 4 and the above-mentioned point 7 of the torch axis.

Figure 6:
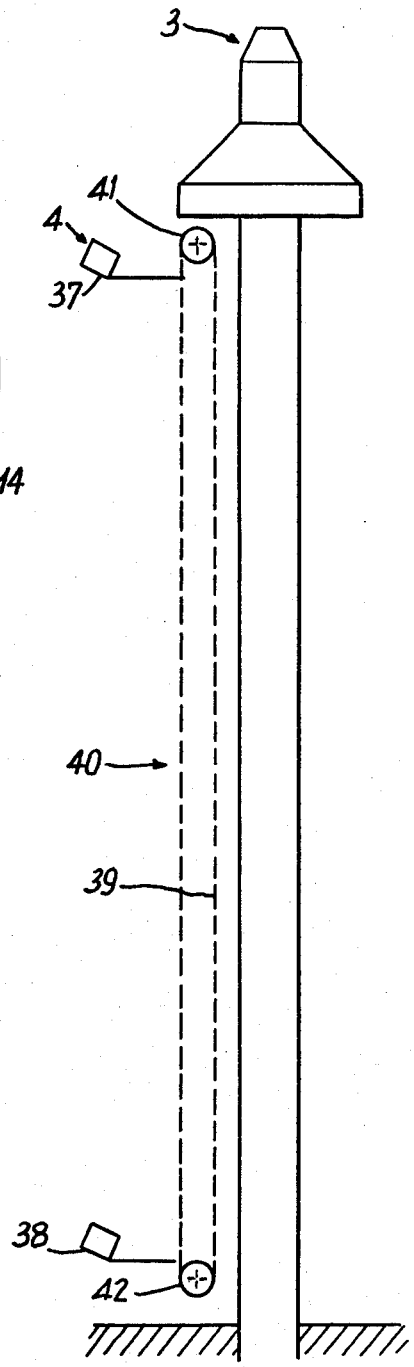
FIG. 6 shows an igniting device which is adapted to be transferred from and to a firing (or shooting) position and a maintenance position.

FIG. 6 schematically shows an igniting system wherein a casing 4 is movable from a firing position 37 to a maintenance position 38, or vice-versa, depending on whether it is used with a hot torch or a cool torch, these displacements being achieved by transfer means 39. Said transfer means are of a conventional type, and are shown here as being constituted essentially by a chain 40 the links of which are articulated with respect to each other, said chain being supported and guided by two pinions 41 and 42; pinion 41 is located slightly above the firing position 37, while pinion 42 is located slightly below the maintenance position, and is driven by a motor. Different transfer means may be used, e.g. a toothed rack (not shown) which cooperates with a pinion driven by a motor.

OPERATION OF THE IGNITING DEVICE

The device is assembled to a torch as described herein-before; when the torch emits combustible gases and thus requires igniting, an electric remote-control device associated to jack 14 causes casing 4 to be opened by rotating cover 11 about the hinge axis 13.

On FIG. 3 the closed position is indicated by full lines, while the open position is represented by dash-dot lines.

A cartridge 22 is thus ignited, or fired, by remote control. The gases issuing from the torch are ignited reliably, due to a convenient selection of the pyrotechnical composition of propulsing elements 35 and propulsed elements 36, and due to the required precision of the assembly, the propulsed elements 36 passing through the cone of residual gases substantially at a location or zone defined by point 7.

Cover 11 is then closed again under the action of the remote-control system.

The composition of the cartridges is so selected that the duration of combustion is very short, and consequently the residual cartridge elements will be entirely extinguished; thus there will be no falling down of the pyrotechnical substances or fragments capable of setting the environment of the torch a-fire.

The efficient thermal isolation and tightness of compartment 18 and boxes 23 containing cartridges 22 ensure perfect conservation of said cartridges over a very long period of time, and also warrant perfect safety during use, whichever may be the moment when immediate igniting or firing is required.

The invention is not limited to the embodiment shown and described herein-above; many modifications and variations may be envisaged by those skilled in the art without departing from the spirit and scope of the invention as defined in the appended claims.

What is claimed is:

1. A device for igniting a torch by means of pyrotechnical cartridges, wherein each cartridge is placed in a casing located at a first distance of one to ten meters from the geometrical axis of the torch and at a second distance of two to twenty meters below the orifice of said torch, said casing being provided with a cover adapted to be moved from a closed position wherein the cartridges within the casing are contained in a thermally isolated tight compartment to an open position wherein each cartridge is aimed at a selected point located on the torch axis at a third distance of one to ten meters above the torch orifice, said second distance being greater than said third distance, and said first, second and third distances being selected in such a manner that $a/(b+c)$ has a value comprised between tangent 45° and tangent 20°, wherein a represents said first distance, b represents said second distance, and c represents said third distance.

2. A device according to claim 1, wherein each cartridge comprises a propulsion element and at least one propulsed element, named "star" and wherein the combustion of said element is completed during a trajectory the length of which is comprised between 1.2 and 3 times the distance between said casing and said selected point of the torch axis.

3. A device according to claim 1, wherein when said casing is in its closed position, said compartment is surrounded by a space in which cooling air is circulated, and is further surrounded by a continuous sheath of heat-insulating material.

4. A device according to claim 1, wherein each cartridge placed in a thermally isolated tight compartment within the casing is disposed within a cylindrical box the lower orifice of which is sealed by a plug provided with a passage for igniting means, while the upper orifice of said box is sealed by a lid adapted to be fractured under the effect of the igniting (firing) of the cartridge.

5. A device according to claim 1, wherein the cover of each casing is adapted to be displaced from its closed position to its open position by means of a hinged jack provided within the tight, thermally isolated compartment.

6. A device according to claim 1, wherein the casings are located on a bridge easily accessible from the ground.

7. A device according to claim 1, wherein said casings are movable between a firing position and a maintenance position sufficiently far from the torch orifice for being easily accessible with the assistance of transfer means.

* * * * *